United States Patent [19]

Sonessa

[11] 3,943,584

[45] Mar. 16, 1976

[54] BED FRAME ARRANGEMENT

[76] Inventor: Joseph P. Sonessa, 4249 Saugus, Sherman Oaks, Calif. 91403

[22] Filed: Jan. 13, 1975

[21] Appl. No.: 540,660

[52] U.S. Cl. ..... 5/299

[51] Int. Cl.[2] ..... A47C 19/00; A47C 23/00

[58] Field of Search ..... 5/200, 200 C, 288, 299, 5/300; 403/190

[56] References Cited

UNITED STATES PATENTS

| | | | |
|---|---|---|---|
| 1,430,123 | 9/1922 | Smith | 5/299 X |
| 1,434,441 | 11/1922 | Koch | 5/99 |
| 1,555,836 | 10/1925 | Dierker | 5/299 |
| 1,617,865 | 2/1927 | Richardson | 5/299 X |

*Primary Examiner*—Casmir A. Nunberg
*Assistant Examiner*—Andrew M. Calvert
*Attorney, Agent, or Firm*—Don B. Finkelstein

[57] ABSTRACT

Detachable bed frame construction for supporting a box spring and mattress and of a type embodying corner posts and lengthwise and transverse horizontal frame members typically comprising angle bars and, in this invention the angle bars have downwardly directed flange portions. Improved joint means are provided for joining the lengthwise and transverse frame members at the corners to the corner posts and to each other. At each corner there is provided a first hollow block or bracket member having an arcuate side wall coupled to a, for example, tubular corner post and the first block or bracket member has an extending lug for coupling attachment to, for example, the transverse frame member.

4 Claims, 8 Drawing Figures

BED FRAME ARRANGEMENT

BACKGROUND OF THE INVENTION

1. Field of the Invention

The field of the invention is that of detachable or disengageable bed frame constructions, more particularly in those of the type providing a very strong yet easily assembled and disassembled arrangement.

Typically, in the concentration of beds a horizonal frame is provided for supporting the box spring and mattress. The frame is generally comprised of lengthwise members and transverse members which are often angle members. The corners of such a frame are often coupled to corner posts. The improved joint of the invention is particularly adaptable for utilization is such a bed construction to provide means for detachable and/or demountable attaching or securing the lengthwise and transverse frame members to the corner posts.

2. Description of the Prior Art

In typical prior art bed construction the bed, as a whole, often comprised a headboard, a footboard, a horizontal support frame for the box spring and mattress and connecting arrangements for providing interconnection therebetween and to the headboard and the footboard. Typically, the headboard and footboard comprise a pair of corner posts as part of the construction thereof and the bottoms of the four corner posts provided are the feet or support portions upon which the entire bed is supported on the floor. The horizontal support frame is spaced upwardly from the floor and may be formed of different types of members and, in most prior art arrangements, included angle bars having an upwardly directed flange. The box spring rested on the horizontal flanges and was retained between the upwardly directed flanges. The horizontal frame thus comprised both longitudinal or lengthwise frame members and transverse frame members.

It has been known to provide detachable or disengageable joints for interconnecting the frame members to allow more convenient storing, shipping and handling of the bed frame. In such prior art arrangements the upwardly directed flanges of the frame members resulted in excessive wear to the box spring due to the normal relative movement therebetween when in use. Additionally, a strong and durable coupling to the corner posts, which is particularly required in beds having very massive headboards and/or footboards, and in which the frame members may still be easily and conveniently joined together or disengaged as required, is desirable.

SUMMARY OF THE INVENTION

The general nature of the construction of the bed frame of the invention incorporates an arrangement of the transverse and lengthwise frame members for supporting the box spring and mattress, detachable joint for interconnecting the frame members and a connection of the frame members to the corner posts. The preferred form of the invention as described in detail hereinafter, the transverse and lengthwise frame members are angle members with a downwardly directed flange. The joints for detachable interconnection therebetween are formed by two interlocking bracket or block members at each of the four corners. One of the bracket members has side walls, one of which side walls has a configuration forming a recess or receptacle adapted for coupling by way of bolts or the like to the corner posts. The side walls of this first block member define an interior cavity and in the side wall opposite the corner post there is provided a groove. The groove in the side wall in the first block member is formed by two oppositely extending portions having a taper in the direction of locking which may be downward.

The second bracket or block member has an extending tongue with an enlarged locking head at the end, the tongue being receivable in the cavity when the tongue is positioned between the tapered portions defining the groove in the other block. For the condition of the tongue in the second block so positioned in the groove of the first block, locking takes place in the direction of the taper securely but removably locking the two block members together in a right angle configuration. The enlarged head prevents the tongue from slipping from the groove and together with the force fit in the tapered groove, provides the strong but detachable connection between the frame members. Each block member has an extending lug or ledge adapted for securement to one of the frame members on the underside thereof adjacent to the downwardly directed flange. This securement may be by way of bolts, welding or the like. Preferably, the extending lug of the first block is coupled to the end of the transverse frame member and the extending lug of the second block is coupled to the end of the lengthwise frame member.

In the light of the foregoing the primary object of the invention is to make available an improved detachable joint means particularly adapted for detachably joining together the bed frame members and coupling to the corner posts in a bed construction.

A further object is to provide improved joint means for each corner of a bed arrangement and comprising two members adapted to detachably interlock, one of them coupled to a transverse frame member and being configurated to be coupled to a corner post and also forming a receptacle providing a groove adapted to interlockingly and detachably receive and engage a tongue on the second joint member, wherein the second joint member is coupled to the lengthwise frame member.

A further object is to provide improvements in bed construction by way of the provision of an additional intermediate transverse support member having secured to it a strap configurated to provide an additional support leg for the bed.

BRIEF DESCRIPTION OF THE DRAWINGS

Further objects and additional advantages of the invention will become apparent from the following detailed description and annexed drawings wherein.

DESCRIPTION OF THE PREFERRED EMBODIMENTS

Figure 1:
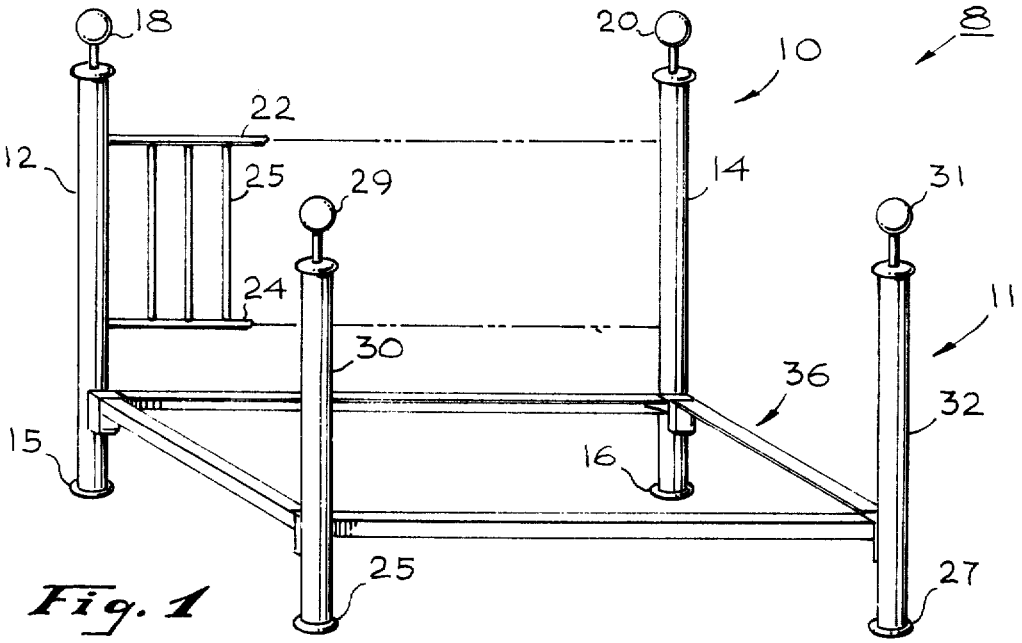
FIG. 1 is a partial isometric view of the type of bed construction wherein the invention may be embodied.

Referring now in more detail to the various Figures of the drawing, FIG. 1 illustrates a typical bed construction 8 in which the invention may be embodied. The headboard 10 is in the form of a frame-like construction embodying corner posts 12 and 14 which, for example, may be tubular members having feet members 15 and 16 at the bottoms thereof and decorative finial members 18 and 20 at their upper ends. Headboard 10 is, in this embodiment and for purposes of illustration only, fabricated of cylindrical tubular members comprising horizontal tubular members 22 and 24 and vertical tubular members such as shown at 25.

It will be appreciated that any type of headboard 10 and any cross sectioned corner posts 12 and 14 may be incorporated in the bed utilizing the present invention. The footboard 11 as shown is of a similar construction to the headboard 10 and comprises the corner posts 30 and 32 which are of construction similar to the corner posts 12 and 14, having feet members 25 and 27 and decorative top finials 29 and 31, respectively. The bed 8 rests upon the feet members 15, 16, 25 and 27.

Figure 2:
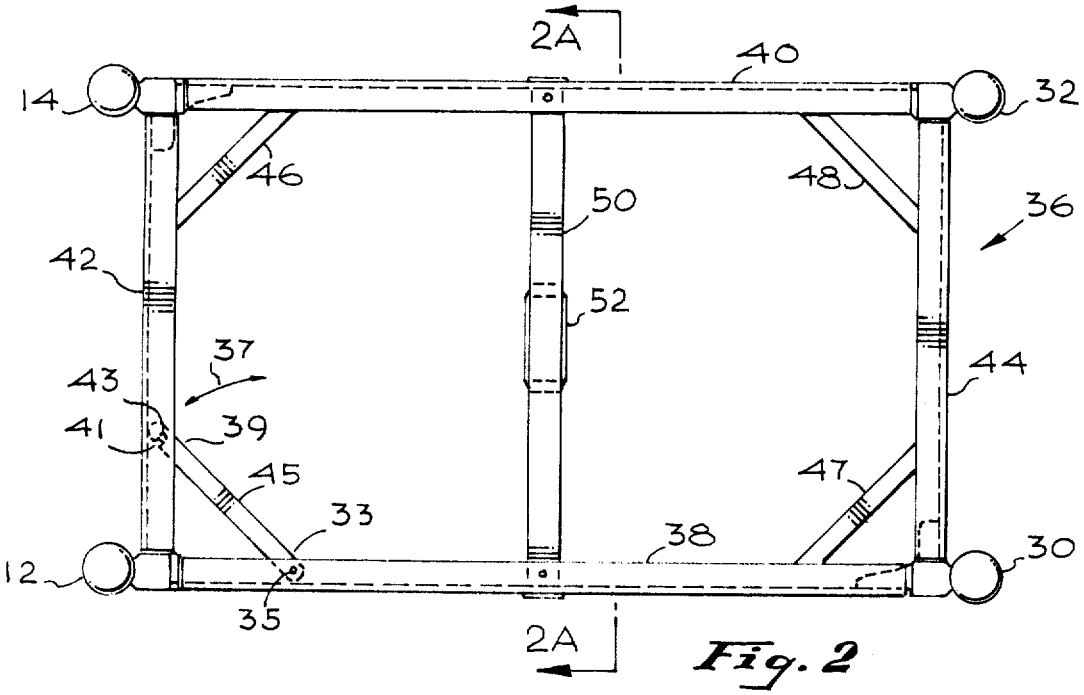
FIG. 2 is a plan view of the horizontal support frame of the bed in FIG. 1.

The bed 8 construction embodies a horizontal frame designated generally at 36 and as shown in detail in FIG. 2. The frame 36 comprises the lengthwise angle members 38 and 40 and the transverse angle members 42 and 44. Corner brace or stiffening members are provided at the corners as designated at 45, 46, 47 and 48 and are preferably detachably coupled at at least one end thereof to the adjacent frame member by well-known means. For example, where it is desired to incorporate the present invention in an embodiment providing repetitively detachable connections between the frame members 38, 40, 42 and 44, each of the corner braces 45, 46, 47 and 48 may be mounted as illustrated in FIG. 2 for the corner brace 45. As shown, a first end 33 of corner brace 45 is pivotally connected to lengthwise frame member 38 by pivot pin 35 for pivotal movement in the direction of the double ended arrow 37. After the frame 36 has been assembled, as described below in greater detail, the other end 39 of corner brace 45, which is provided with slot 41, may be pivotally swung into cooperative locking engagement with locking pin 43 coupled to transverse frame 42. If desired, however, the corner braces 45, 46, 47 and 48 may be permanently secured to the frame members 38, 40, 42 and 44 in those embodiments in which a premanent assembly is desired.

Figure 2A:
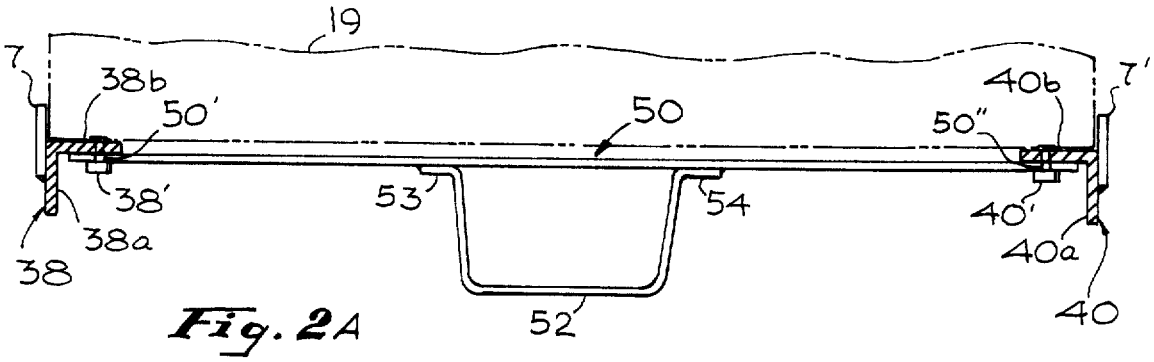
FIG. 2A is a view along the line 2A—2A of FIG. 2.

Extending midway between the transverse members 42 and 44 is a further transverse member 50 in the form of a strap which is secured by suitable means to the lengthwise members 38 and 40 at approximately their midpoints. As shown in more detail on FIG. 2A, numeral 52 designates a strap of metal bent into a configuration as shown in FIG. 2A which, for example, is a V or U shape configuration. Flat end parts 53 and 54 are secured by suitable means such as welding, or the like, to the underside of the strap 50. The part 52 thus forms an additional support leg for the bed 8 in a location whereby it is most effective for its purpose.

As shown on FIG. 2A, the lengthwise frame members 38 and 40 are angle members having downwardly directed flange portions 38*a* and 40*a*, and horizontal flange portions 38*b* and 40*b*, respectively. The box spring 19 of bed 8, shown in phantom lines on FIG. 2A, rests upon the horizontal flange portions 38*b* and 40*b*.

The transverse frame members 42 and 44 are similarly positioned with downwardly directed flange portions and horizontally directed flange portions for support of the box spring 9. Tabs 7 and 8 are coupled to the lengthwise frame members 38 and 40 to prevent relative transverse movement of the box spring 9 and frame 36 which would allow the box spring 9 to slide off the frame 36. The headboard 10 and footboard 11 similarly prevent relative lengthwise movement of the box spring 9 with respect to the frame 36.

The downwardly directed flange portions of the frame members 38, 40, 42 and 44 is preferred to prevent undue wear on box spring 9 which is caused by relative movement between the frame 36 and box spring 9 in normal use of the bed 8.

The additional transverse strap 50 may be detachably coupled to the frame 36 by means of lock pins 38′ and 40′ coupled to frame members 38 and 40, respectively, fitting into lock pin accepting grooves 50′ and 50″ in strap 50. Such a detachable connection is desired in those embodiments of the present invention wherein the frame 36 is detachably coupled or joined together. Otherwise, a permanent connection of the strap to frame members 38 and 40 may be made if desired after assembly of frame members 38, 40, 42 and 44.

The lengthwise frame members 38 and 40 and transverse frame members 42 and 44 are preferably detachably coupled together to form the frame 36 which is secured to the corner posts and supported from the corner posts. The joint connection of the present invention provides for such detachable connection as well as the fixed connection to the corner posts.

Figure 3:
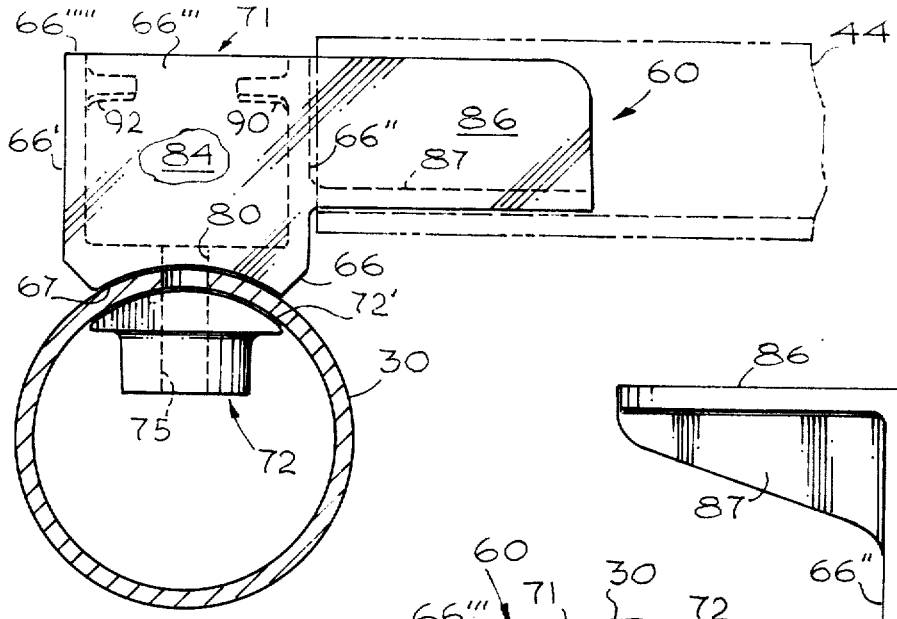
FIG. 3 illustrates a first joint or block member of the present invention coupled to a corner post.
Figure 5:
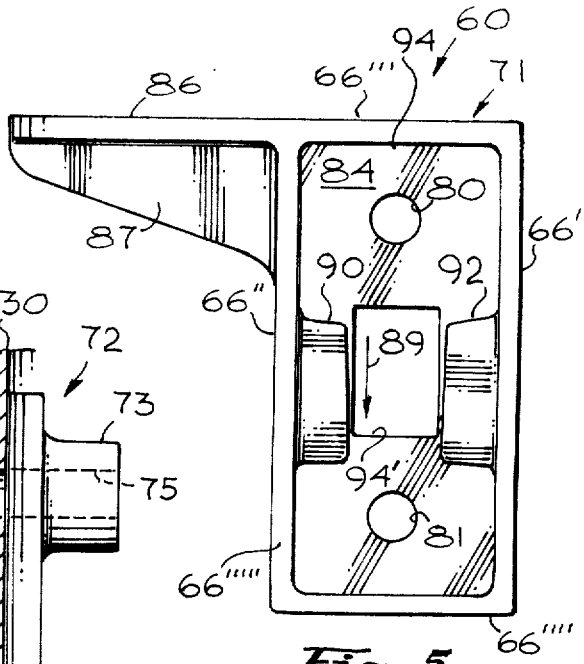
FIG. 5 is an interior view of the first joint or block member of FIGS. 3 and 4.
Figure 4:
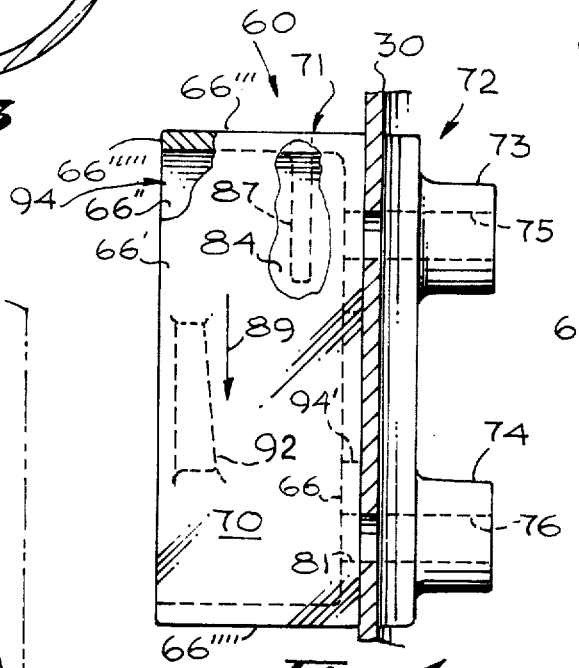
FIG. 4 is a side view of the first block or joint member of FIG. 3.

The improved joints are constructed primarily of two joint or block members which preferably may be castings. The joint members are illustrated more in detail in FIGS. 3 through 7 for coupling of frame members 38 and 44 and the connection to post 30. The other three corners are similarly constructed. FIGS. 3, 4 and show a first joint or block member as designated at 60, the second block member is shown at 62 in FIG. 6 wherein it is shown an interlocking engagement with the first block member 60. FIG. 7 is an end of interior view of the second joint or block member 62.

The block member 60 has a flat top as may be seen in FIG. 3 and at one side is an extending side wall 66 having, in this embodiment, an arcuate recess 67 the radius of which corresponds to the outside radius of the corner post 30 shown in cross section. The front side of the block member 60 is flat as may be seen at 70 in FIG. 4. To achieve connection to corner post 30, numeral 72 designates a clamping member having a cross sectional configuration as may be seen in FIG. 3, having wall surface 72′ with an arcuate configuration to match the inside radius of corner post 30. It has two extending bosses 73 and 74, there being holes or bores through these bosses as designated at 75 and 76 to receive suitable attachment means such as bolts (not shown). The side wall 66 of the block member 60 has corresponding holes 80 and 81 adapted to receive the bolts utilized for securing the clamping member 72, which is on the inside of the corner post 30, to the arcuate surface 67 of the block member 60.

As pointed out, block member 60 may be in the form of a casting having side walls 66, 66′, 66″, 66‴, 66⁗, and 66′′′′′, which form a receptacle 71 having a cavity 84. As may be seen, the block 60 has an extending lug or ledge 86 which includes a strengthening web 87 on the underside and extending back to the rectangular body of the block member. The lug 86 is secured to the end of transverse frame member 44 by suitable means such as welding, bolting or the like, to provide the receptacle 71 spaced from the frame member 44 as shown.

On the inside of the block member 60, that is in the cavity 84, there are two oppositely extending groove forming portions or wings as designated at 90 and 92 which are tapered. That is, they become thicker in a downward direction which is a direction indicated by the arrow 89 in FIG. 5. Numeral 94 designates a square hole or opening in the side wall 66''''' of the block 60 and the side wall 66''''' is oppositely disposed to the side wall 66 having the arcuate surface 67 for attachment to corner post 30.

Figure 6:
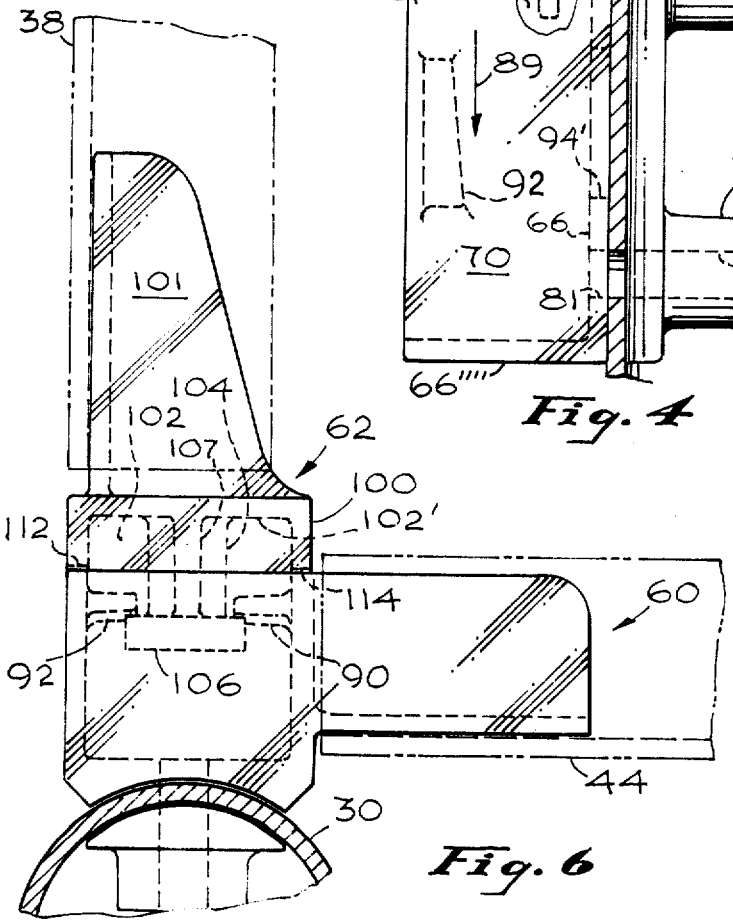
FIG. 6 illustrates the first and second block or joint members forming the joint and showing them interlocked together.
Figure 7:
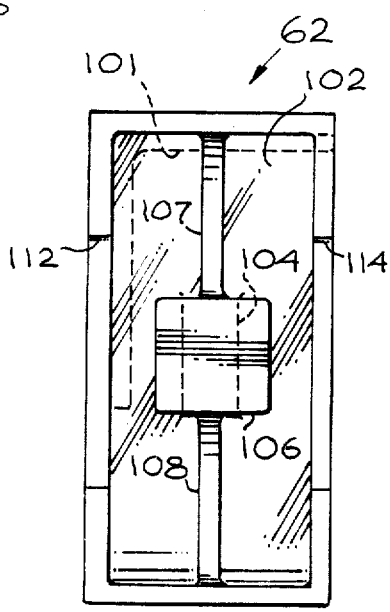
FIG. 7 is an interior view of the second block or joint member shown in FIG. 6.

Referring now more particularly to FIGS. 6 and 7, FIG. 6 shows the second joint or block member 62 in an interlocking relationship with the block member 60. The member 62 has a generally rectangular pad as designated at 100, interior of which, as shown in FIG. 7 is a cavity, as designated at 102, the depth of which can be seen in FIG. 6. Extending outwardly from the inside face 102' of the cavity 102 of block member 62 is a tongue 104 as may be seen in FIG. 6 and on the end of this tongue is an enlarged transverse head portion 106. Numerals 107 and 108 designate the strengthening ribs on the interior of the cavity 102 of rectangular pad 100, which ribs extend between the ends and the tongue 104 and the surface of which are inwardly recessed. When the block members 60 and 62 are joined they are held in a tight juxtaposed relationship. The faces of the side edges of the rectangular pad 100 have shallow recesses or recessed surfaces as designated at 112 and 114 so that these surfaces do not come into direct contact with a juxtaposed surface on the block member 60 thus leaving clearance to prevent trapping of air within the cavity 84 in the block member 60.

The block member 62 may be removably or detachably secured or engaged to or with the block 60 while the block 60 is clamped to the corner post 30. It will be understood that the wings 90 and 92 previously described form a groove between them so that with the tongue 104 and head 106 the parts form a tongue and groove like joint.

In assembling the joint, the block 62 is brought up to the block 60 and the tongue 104 with the lug 106 on the end is inserted into the cavity 84 through aperture 94 in a position in a position so that the tongue 104 can be brought down through the groove between the lugs or wings 90 and 92 with the transverse head 106 in cavity 84 as may be seen in FIG. 6. As the tongue 104 and head 106 are moved downwardly, because of the taper of the wings 90 and 92 as previously described, the block 60 and 62 are pulled into tight juxtaposed relationship as shown in FIG. 6 with the head 106 in tight engagement with the wings 90 and 92 yet in such a way that manual disengagement is readily possible.

When the blocks are engaged they are in right angle relationship as shown in FIG. 6 with the extending lug or ledge 102 of the block 62 coupled by welding, bolting or the like to lengthwise frame member 38. Thus it may be seen that the lengthwise frame members 38 and 40 may be disengaged or detached from transverse frame members 42 and 44 simply by manually disengaging the blocks 62 from the blocks 60 which are coupled to the corner posts. The blocks 60 and 62 are configurated so that frame members 38, 40, 42 and 44 are substantially coplanar in a horizontal plane.

From the foregoing it will be observed that the joints are made up from blocks which provide disengageable tongue and groove joints between the frame members but wherein the blocks are held firmly and securely together and coupled to the bed corner posts. Each of the block members may be a casting adapted for easy and economical fabrication and assembly.

From the foregoing, those skilled in the art will readily understand the nature and construction of the invention and the manner in which it realizes and achieves all of the objectives and advantages as has been set forth in the foregoing.

The foregoing disclosure is representative of the preferred form of the invention and is to be interpreted in an illustrative rather than a limiting sense and the invention to be accorded the full scope of the claims pending hereto.

I claim:

1. In a bed arrangement of the type having a frame means defining an open, right angle, quadrilateral configuration lying in a substantially horizontally disposed plane, a headboard and a footboard spaced from the headboard and said headboard and footboard lying in substantially vertical planes, and each of said headboard and footboard having corner posts at the ends thereof and each of said corner posts having foot members for supporting the bed, and said frame means coupled to each of said corner posts and spaced vertically upwardly from said feet members, the improvement comprising, in combination:

said frame means comprising a pair of transverse frame members and a pair of lengthwise frame members;

joining means for detachably joining together said transverse frame members to said lengthwise frame members at the corners of said right angle quadrilateral configuration of the frame means, and said joining means for coupling said frame means to each of said corner posts, and said joining means comprises:

first block members, one at each end of said transverse frame members and each having:

a lug portion coupled to the end of said transverse frame members;

a body portion extending beyond the ends of said transverse frame members, and said body portion having:

side walls defining a cavity, and:

a first of said side walls having an external surface having a geometric configuration corresponding to the outside geometric configuration of said corner posts and adjacent thereto, and said first side wall having a plurality of bolt-accepting apertures therethrough, said corner posts having walls in regions adjacent to said side wall of said first block members defining a tubular configuration and having a plurality of apertures therethrough aligned with said plurality of apertures in said first side wall of said block member;

a second side wall of said body portion of said first block member oppositely disposed and spaced from said first side wall and having walls defining a tongue portion receiving aperture therethrough;

a pair of spaced apart wing members coupled to said second side wall of said body portion of said first block member in said cavity defining a tongue accepting groove therebetween, and said wing members progressively increasing in thickness from a thin end adjacent the top of said aperture in said second side wall to a thick end adjacent the bottom of said aperture in said second side wall;

a pair of second block members having lug portions, one of said second block members coupled by said lug portion thereof to each end of said lengthwise frame members and having:

a pad portion extending beyond the ends of said lengthwise frame members;

a tongue portion extending from said pad portion and positionable through said aperture in said second side wall of said body portion of said first block member in said groove defined by said pair of spaced apart wing members; and, an enlarged head portion coupled to the outer end of said tongue portion for frictionally clamping engagement with said tapered wing members in the interior of said cavity, whereby said taper in said wing members provides a clamping, wedging frictional retention of said second block member in right angular relationship to said first block member and said lengthwise frame members in right angle and substantially horizontally coplanar relationship to said transverse frame members;

a clamping means positioned in the interior of said tubular portion of said vertical posts adjacent said apertures through said wall of said tubular posts, and said clamping member having bolt-accepting apertures therethrough aligned with said apertures in said wall of said vertical posts, and bolt means extending through said bolt-accepting apertures in said first side wall of said body portion of said first block member, through said apertures in said wall of said vertical posts and through said bolt-accepting apertures in said clamping member, and nut means for engaging said bolt means for clamping said clamping member, said vertical posts and said first block member together.

2. The arrangement defined in claim 1 wherein:

each of said transverse frame members and said lengthwise frame members comprise angle members having a horizontal flange and a vertically downwardly disposed flange.

3. The arrangement defined in claim 2 and further comprising:

corner brace members adjacent each corner of said frame means, and each of said corner brace member having a first end pivotally coupled to one of said adjacent transverse and lengthwise frame members and a second end having walls defining a lug receiving aperture therein; and, a plurality of lugs mounted on the other of said transverse and lengthwise frame members for locking insertion in said lug receiving aperture of said corner brace members.

4. The arrangement defined in claim 3 and further comprising:

an intermediate transverse support detachably coupled to said lengthwise frame members adjacent to mid points thereof and extending therebetween substantially parallel to said transverse frame members, and a support member coupled to underside of said intermediate transverse support member having a bottom portion substantially coplanar with said feet of said vertical posts to provide additional support for the bed; and, a pair of tab members, one coupled to each of said lengthwise frame members adjacent the mid points thereof and extending vertically upward therefrom for retaining a box spring on said horizontally deposed flange of said frame members.

* * * * *